US006179451B1

(12) United States Patent
Bodine et al.

(10) Patent No.: US 6,179,451 B1
(45) Date of Patent: Jan. 30, 2001

(54) INTEGRATED INDIRECT LIGHT AND CEILING SYSTEM

(75) Inventors: Darryl C. Bodine, Lancaster; William C. Dorsey, Conestoga, both of PA (US)

(73) Assignee: Armstrong World Industries, Inc., Lancaster, PA (US)

( * ) Notice: Under 35 U.S.C. 154(b), the term of this patent shall be extended for 0 days.

(21) Appl. No.: 09/252,867

(22) Filed: Feb. 18, 1999

(51) Int. Cl.[7] ..... F21S 8/06

(52) U.S. Cl. ..... 362/404; 362/147; 362/151; 362/225; 362/290; 362/148

(58) Field of Search ..... 362/148, 147, 362/151, 404, 150, 225, 290

(56) References Cited

U.S. PATENT DOCUMENTS

| | | | |
|---|---|---|---|
| D. 362,315 | 9/1995 | Herst et al. . | |
| 2,752,017 | 6/1956 | Segil . | |
| 4,332,005 | 5/1982 | McCall . | |
| 4,388,675 | 6/1983 | Lewin . | |
| 4,390,930 | 6/1983 | Herst et al. . | |
| 4,660,131 | 4/1987 | Herst et al. . | |
| 4,748,543 | 5/1988 | Swarens . | |
| 4,760,505 | 7/1988 | Cole, Jr. . | |
| 5,146,393 | 9/1992 | Crane . | |
| 5,160,193 | 11/1992 | Fabbri et al. . | |
| 5,161,878 * | 11/1992 | Degelmann et al. | 362/150 |
| 5,199,782 | 4/1993 | Johnson et al. . | |
| 5,709,460 * | 1/1998 | Lester | 362/147 |
| 5,782,551 * | 7/1998 | Capaul | 362/148 |
| 5,988,836 * | 11/1999 | Swarens | 362/364 |

* cited by examiner

*Primary Examiner*—Thomas M. Sember
*Assistant Examiner*—Ali Alavi

(57) ABSTRACT

An indirect fluorescent lighting fixture arrangement for a suspended grid ceiling that includes elements that combine with the ceiling grid to form a fixture. A panel frame element engages the grid from below and simultaneously acts as part of the ceiling and part of the fixture.

13 Claims, 6 Drawing Sheets

25
D
56
58
D
55
45

57
D
D
55
45

D
D
55

C
55
58
C
43
25
C
55
C
45
55
C
43
58
C

INTEGRATED INDIRECT LIGHT AND CEILING SYSTEM

BACKGROUND OF THE INVENTION

1. Field of the Invention

This invention relates to a system that integrates an indirect light with a suspended grid ceiling.

2. Description of Related Art

Suspended ceilings having a metallic grid that supports panels in grid openings are common. Generally, in such ceilings, direct lighting fixtures replace panels in selected grid openings to provide room illumination. Such light fixtures are commonly simply open bottom boxes that have a number of fluorescent light tubes mounted therein, in parallel, with a translucent cover on the bottom of the box. The box is supported on the grid. In direct lighting, light from the tubes shines directly downward through the translucent cover into the room. Generally, the tubes are visible from below. Such direct form of fluorescent lighting is relatively inexpensive, but very plain and utilitarian, without much decorative effect.

An alternative type fluorescent lighting of an indirect, reflected, type is occasionally used with suspended grid ceilings. Such indirect lighting, wherein the fluorescent tubes cannot be seen, yields a glow over the room, which can be used to achieve desirable decorative effects. No translucent or other light passing covers, panes or lenses, are normally used in this type of lighting, with the light shining through open space into the room after being reflected.

In one form of indirect lighting, the tubes are positioned below the ceiling panels of the suspended ceiling, and reflect against the ceiling into the room. Opaque shields conceal the tubes from view from the room below. Such installations are generally custom designed and installed, with attendant, generally extensive, expense.

Efforts have been made to provide indirect lighting fixtures that can be supported in grid openings as in direct lighting fixtures, to avoid the expense of custom designing and installing indirect lighting which reflects against the ceiling. In this form of indirect lighting in suspended grid ceilings, the fixture reflects light through a grid opening itself, as in U.S. Pat. No. 5,709,460. In such patent, the tubes are positioned above and behind panels adjacent the openings, and thus concealed from view from below. The light is reflected from a dome over the opening and tubes, into the room below, through the grid opening. A mask is optionally secured to the fixture to reduce the area of the opening through which the reflected light travels, and to further conceal the light tubes from view from below. The fixture, including the reflector dome, rests on the grid beam flanges.

BRIEF SUMMARY OF THE INVENTION

The present invention is for an indirect light that includes elements that combine with a grid beam frame in a suspended ceiling to form the fixture.

The invention uses a special panel frame that engages the grid frame that surrounds an opening in a suspended grid ceiling. This panel frame simultaneously serves as (1) a decorative and functional part of the suspended ceiling, and (2) an element in the indirect lighting fixture that (a) masks the tubes from viewing from below, and (b) permits light reflected from the tubes to pass unobstructed into the room below, and (c) when the fixture is designed to be sound absorbing, the panel frame absorbs the sound, and permits sound to reach the sound absorbing surfaces within the fixture.

The panel frame or coffer, in the event the panel is recessed, of the invention, is secured to the grid frame, from below, without interference from the other elements of the fixture, which rest on the grid frame, above the grid.

The panel frame element of the invention can be in the form of a relatively elaborate coffer frame, or simply a panel substantially the same as the remaining panels in the ceiling, except for an opening in the panel frame that permits the reflected light to shine through and sound to reach an absorbing surface, when a sound absorbing surface is optionally present within the fixture. The panel frame design is chosen to be compatible with the rest of the suspended ceiling.

The panel frame or coffer of the invention is inserted from below, just as the remaining panels in the ceiling are inserted, after the dome and light frame are in place.

With or without the lights on, the panel frame element simultaneously serves as both a decorative and functional part of the ceiling, and a part of the indirect light fixture that serves to mask the tubes.

The ceiling grid beams form a grid frame that surrounds the grid opening in which the light fixture is located. The grid frame serves as a structural element in the ceiling, and as the element in the light fixture that supports the light frame and dome, and connects the panel frame to those light elements.

The entire light fixture of the invention also serves as a decorative element in the ceiling, with or without the lights on, as well as a functional element wherein the grid opening is enclosed by the panel frame, light fixtures, and dome. When the dome and/or the panel frame are made of sound absorbing material, the light fixture of the invention also contributes to the acoustical effects of the grid ceiling.

BRIEF DESCRIPTION OF THE DRAWINGS

FIG. 7 shows the first step in inserting the panel frame.

FIG. 8 shows the second step in inserting the panel frame.

FIG. 9 shows the final step in inserting the panel frame, and the panel frame in place in the grid frame.

DETAILED DESCRIPTION OF THE INVENTION

Figure 1:
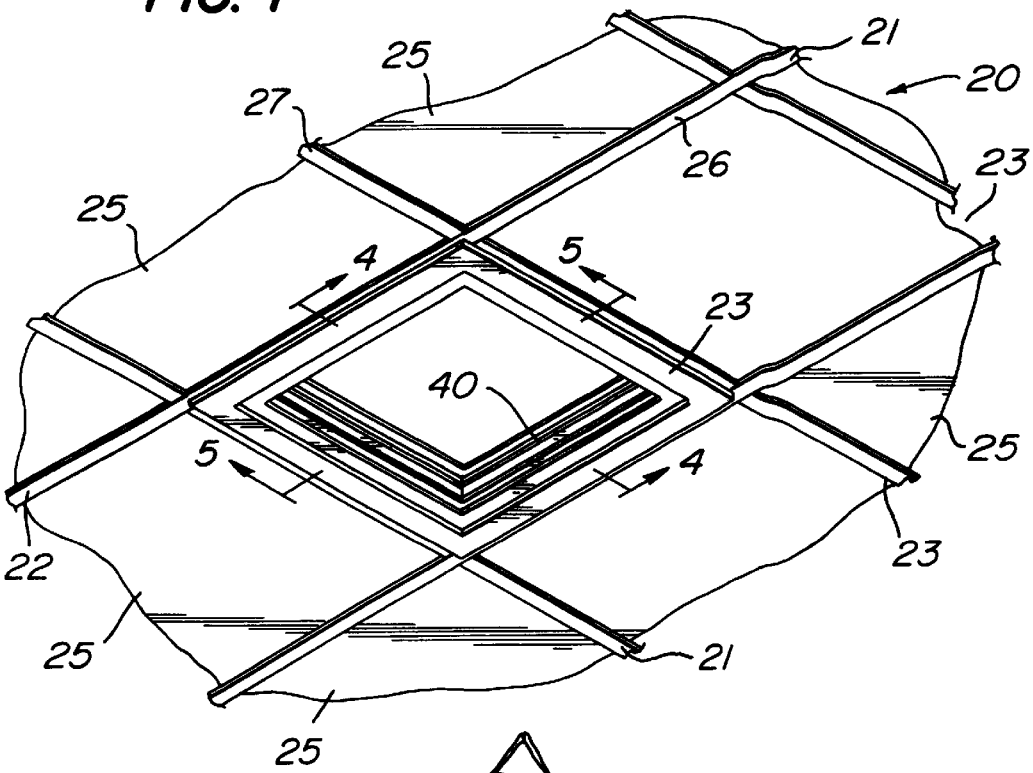
FIG. 1 is a perspective view taken from below of a suspended grid ceiling, with the light fixture of the invention in place in a grid opening.
Figure 3:
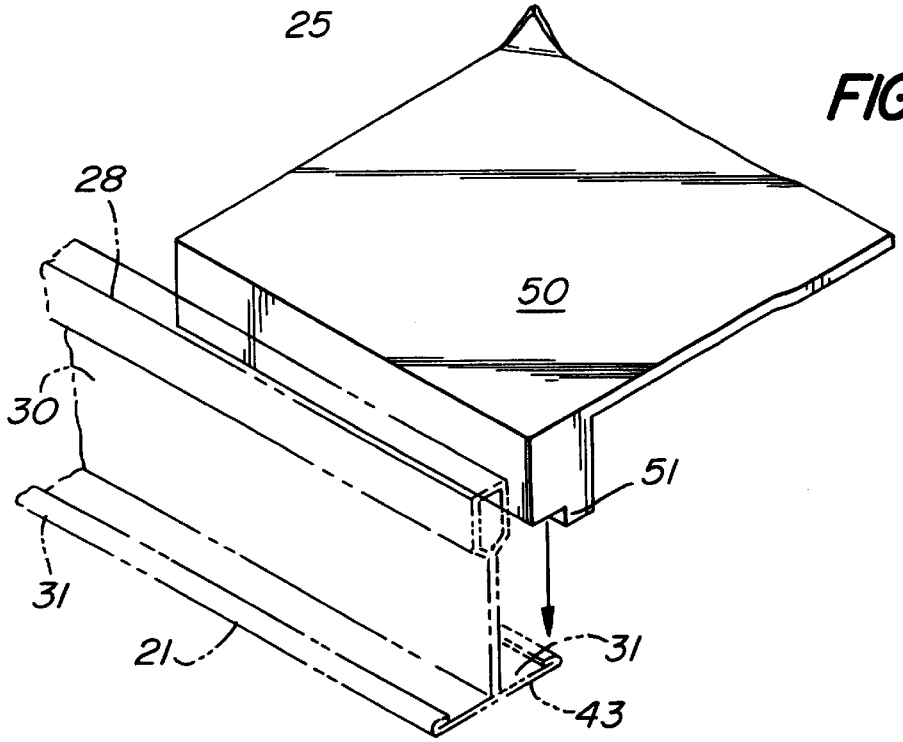
FIG. 3 is a fragmentary exploded perspective view of the support bracket on the light frame element of the fixture of the invention.
Figure 2:
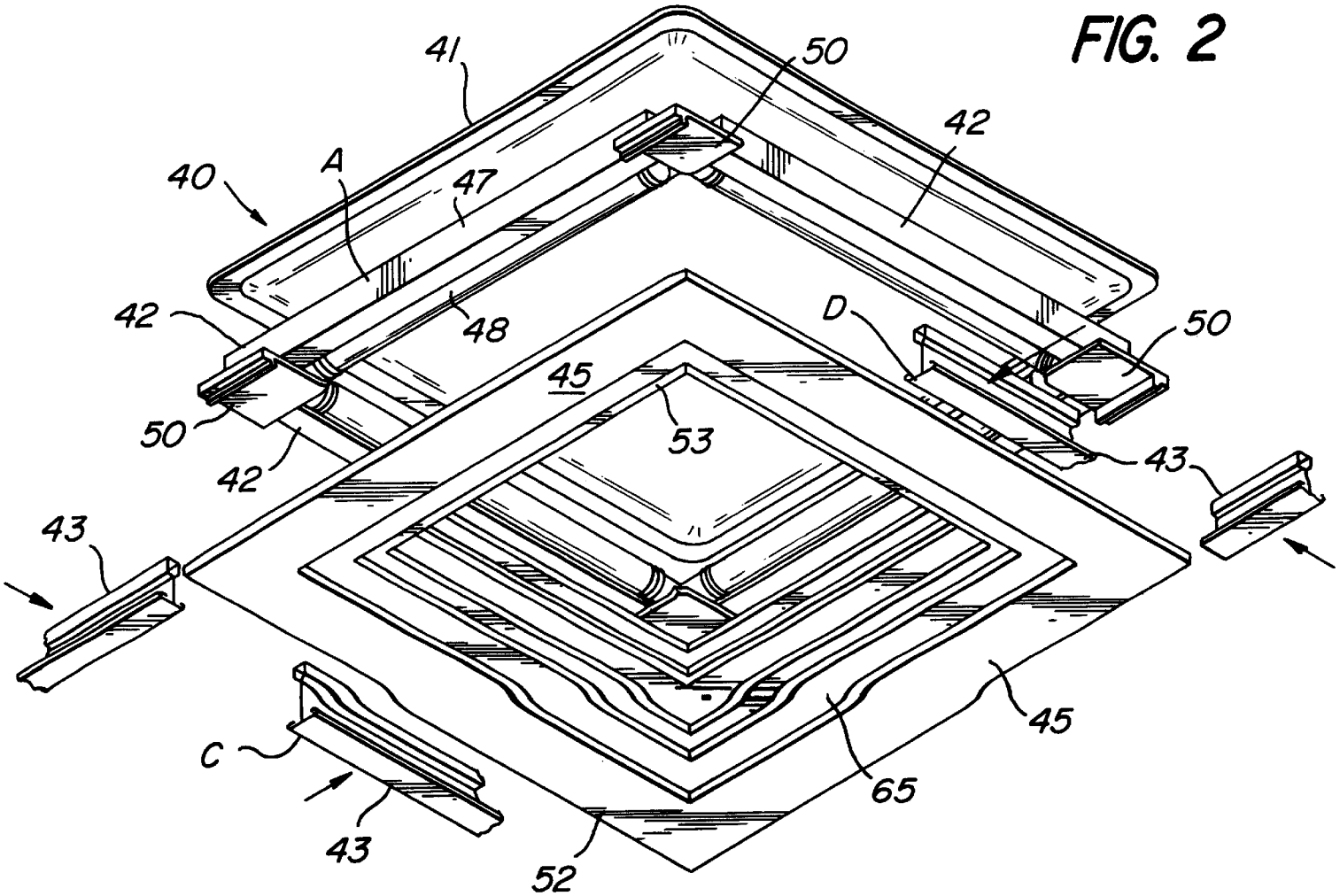
FIG. 2 is a partial exploded perspective view of the fixture of the invention as shown in FIG. 1.

A suspended ceiling 20 has a grid 21 of beams 22 that intersect to form multiple rectangular openings 23. Openings 23 are generally, when the present invention is used, square, of a 24"×24" size. Acoustical panels or tiles 25 are set in the openings. The ceiling functions to enclose the room overhead and to decorate the room to the extent desired by the use of colors, textures, and designs in the panels and optionally in the grid. The grid 21 can be fully or partially exposed to view from below, or totally concealed. Such ceilings are well known.

The beams 22 of the grid 21 include main runner 26 and cross runners 27 that interconnect.

The entire suspended ceiling 20 including grid 21, and panels 25, is suspended from a structural ceiling by wires anchored in the structural ceiling and connected to holes in the main runners 26 of the grid 21.

The beams 22 have a cross-sectional shape in the form of an inverted T, with a bulb 28 at the top, a vertical web 30, and horizontally extending flanges 31 at the bottom of the beam.

As is well known, the ceiling tiles or panels 25 are supported on the flanges 31 of the T in each rectangular opening 23. The panels 25 are inserted into each grid opening 23 from below the grid 21 when constructing the suspended ceiling 20.

The fixture 40 of the invention is located in one of the grid openings 23 in the suspended ceiling 20. A ceiling panel 25 is omitted from such opening.

The fixture 40 is a combination of a dome 41, a light frame 42, a grid frame 43, and a panel frame 45.

Fixture 40 has at the top a reflecting dome 41. The dome 41 has a flat, horizontal perimeter edge strip 46. The dome 41 then rises in curved fashion from the strip as seen particularly in FIGS. 4 and 5, into a flat or curved roof section at the top of the dome 41. The dome 41 is preferably formed, as by molding from plastic, in one piece, and has a light reflective undersurface of a color desirably chosen to harmonize with the remainder of the fixture and ceiling. The dome 41 can optionally be made of sound absorbing material.

The dome 41 rests on a light frame 42 that extends horizontally below the dome 41. The fixture 40 is of rectangular shape, usually square, in plan view, and conforms to the interior of the grid opening 23 in which the fixture 40 is located.

The light frame 42 has four sides designated first opposing sides A and B and intervening opposing sides C and D.

One or more sides of the light frame 42 itself has a basic structural member 47 for supporting the fluorescent tube 48 which is essentially a channel member having therein the necessary ballast and starter for a fluorescent tube 48, along with receptacles at the end for receiving the fluorescent tube contacts. Such structure is common in the prior art. The tubes 48 may be of an appropriate length for the grid opening 23 (for example, 18, 24 or 48 inches). The tubes 48 may be on all four sides of the light frame 42, or only on two opposing sides, as for instance two opposing 48" (inch) tubes in a 24"×48" opening, or even only on one side. Generally, the light frame 42 would have tubes 48 on each side, when the light frame 42 is for a 24"×24" opening. The channels of the light frame 42 are structurally connected at their corners. On a side where there is no tube channel, a simple structural bar is inserted. Suitable corner members connect the tube channels and structural bars. The light frame 42 is thus essentially an open rectangle with one or more fluorescent tubes 48 along one or more of the sides.

Of importance in the invention are supporting brackets 50, which are affixed to the light frame 42 on the underside and are designed to rest on the bottom flange 31 of the grid beams 22 that extend around the four sides of the grid opening 23, and to provide clearance between the light frame 42 and grid frame 43. The brackets 50 optionally have an angle cutout that forms a shoulder 51 around the inner perimeter of the flange 31 around the grid opening 23, which positions the frame 42 horizontally within and above the opening.

The brackets 50 are affixed only on first opposing sides A and B of the frame, so that they rest only on the flanges 31 of corresponding first opposing sides A and B in the grid opening 23. The brackets 50 support the light frame 42 above the flanges 31 of grid frame 43 around grid opening 23 and provide clearance between the bottom side of the light frame 42 and the upper surfaces of the flanges 31 of grid frame 43.

Of particular importance to the invention is that the flanges 31 on intervening opposing sides C and D of the grid opening 23 that correspond to intervening opposing sides C and D of the light fixture 40, are free of any interference or obstruction to the insertion of another element of the invention, the panel frame 45.

The panel frame 45 is of a design that is compatible with the rest of the ceiling. It has a perimeter section 52 that serves to hide the fluorescent tubes 48 from viewing from below, and a central opening 53 that permits reflected light to enter the room. The panel frame 45 may be of a coffered design 65, wherein there is a recessed portion 66 about the central opening 53 that recedes up into the ceiling. The recessed portion 66 may be stepped as at 67 to provide a pleasing appearance and structure that further hides the tubes 48 from direct view from below. The panel frame 45 may be formed of the same composition as the rest of the ceiling panels or tiles 25, or may be of a separate material such as metal, plastic, or of a relatively dense compacted woodchip, or other suitable material, molded or otherwise, of the same or different color as the rest of the ceiling. The composition of panel frame 45 may be chosen to be sound absorbing.

The panel frame 45 has first opposing sides A and B, and intervening opposing sides C and D which correspond to the like designated sides on the light frame 42, and the grid frame 43.

Figures 7, 8, 9:
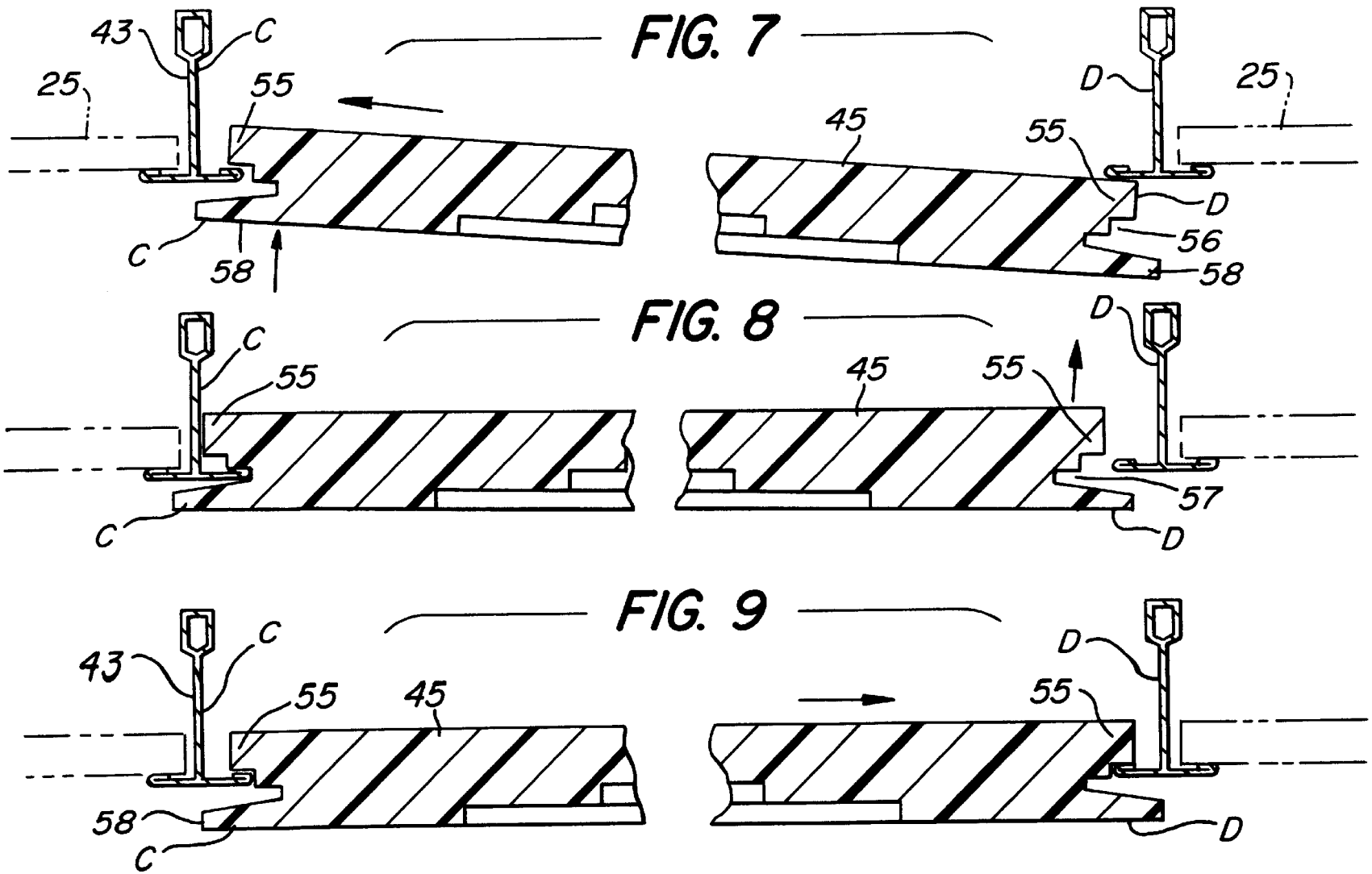
FIGS. 7 through 9 are sectional elevations of the panel frame of the invention being inserted into the grid frame.

The panel frame 45 of the fixture 40 of the invention must have a perimeter thickness that permits an edge configuration on intervening opposing sides C and D to engage flanges on intervening opposing sides C and D in the grid opening 23 in the manner shown in FIGS. 7 through 9. The panel frame 45 must be capable of being inserted from below, with the dome 41 and light frame 42 in place, without interference from those elements. This is accomplished with a panel frame 45 having a configuration on intervening opposing sides C and D that permit the panel frame 45 to be shifted into place in the confined area below the light frame 42 and above flanges 31.

As seen in FIGS. 7 through 9, each of the edges C and D of the panel frame 45 has a top shoulder 55, a first recessed portion 56, a second recessed portion 57, and a lower lip 58.

The panel frame 45 is inserted into place by bringing side C up into position as shown by the arrow in FIG. 7, until lower lip 58 contacts flange 31. The panel frame 45 is then shifted to the left as seen by the arrow in FIG. 7 until the panel frame 45 is in the position seen in FIG. 8. The panel frame 45 is then moved upward as shown by the arrow in FIG. 8, on opposing side D, and then shifted in the direction of the arrow in FIG. 9 into the position shown in that Figure.

Figure 4:
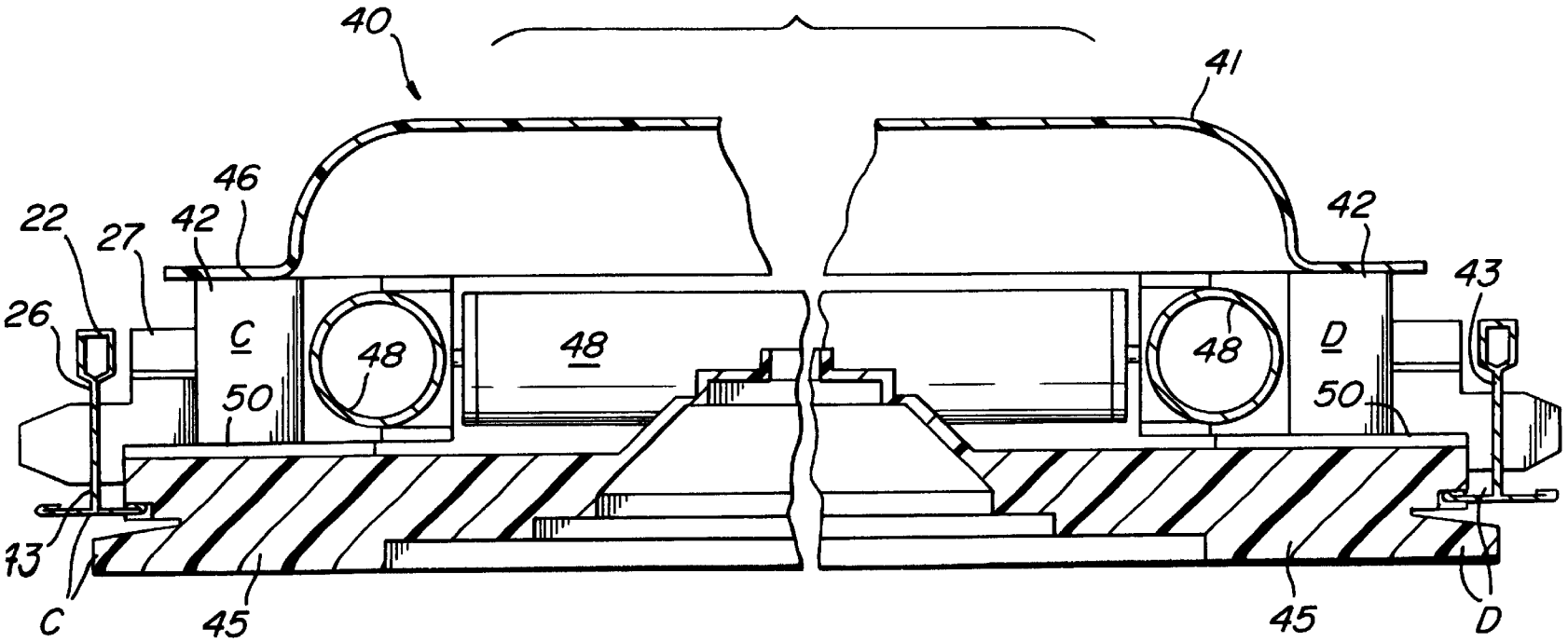
FIG. 4 is a sectional elevation taken on the line 44 in FIG. 1.
Figure 5:
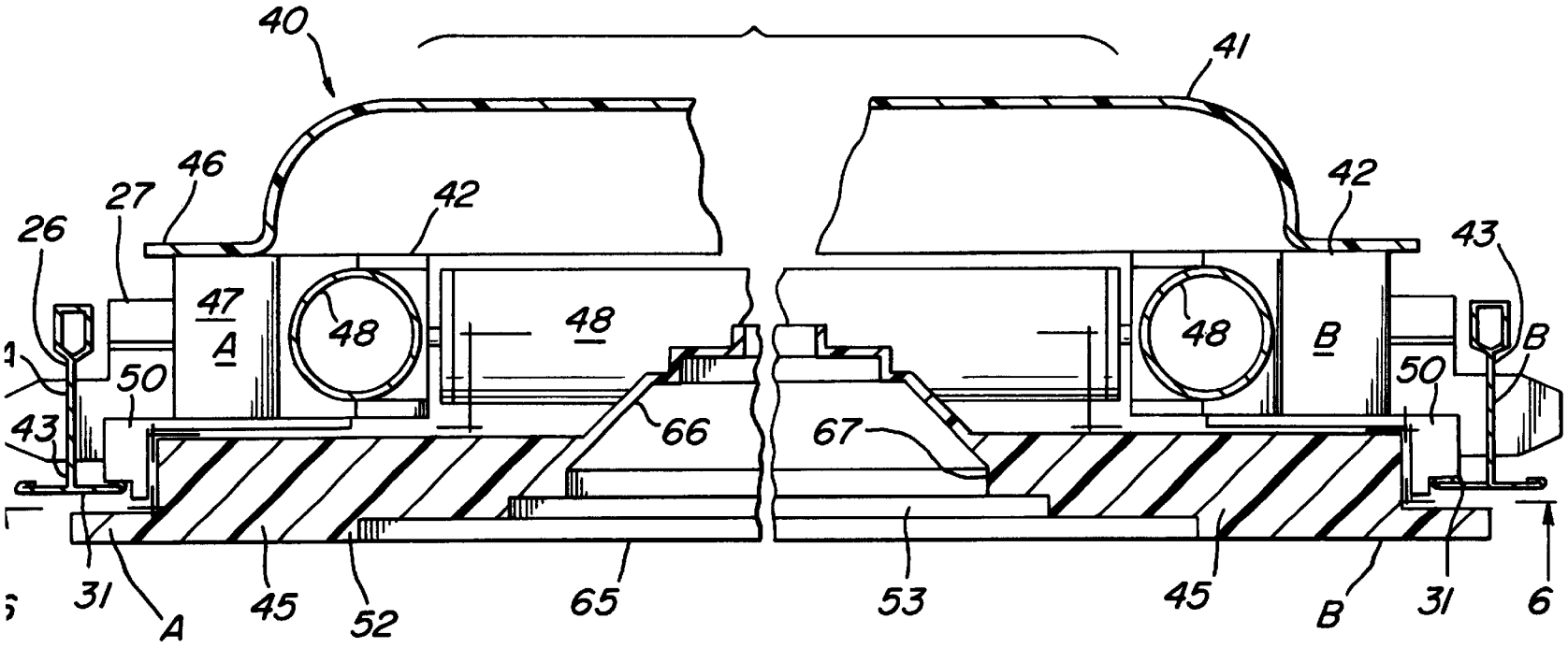
FIG. 5 is a sectional elevation taken on the line 55 in FIG. 1.
Figure 6:
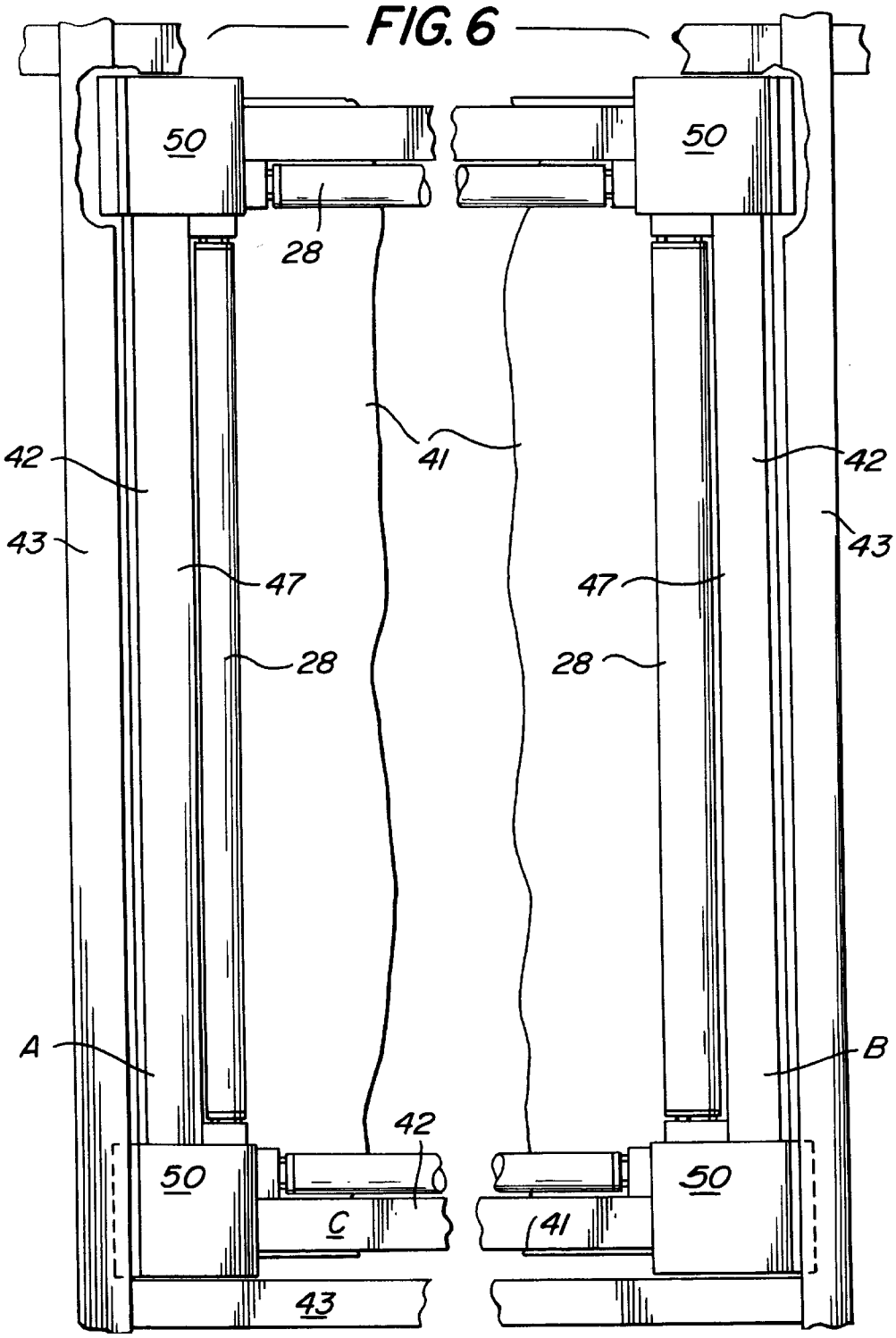
FIG. 6 is a fragmentary plan view, taken from below on line 6—6 of FIG. 5, of the light frame and dome of the light fixture resting on the grid frame.

No interference is encountered from the edges A and B of the panel which have a stepped cut back 59 as shown in FIGS. 4 and 5. Edges A and B on panel frame 45 do not support the panel frame 45 from the adjacent flanges in the grid frame 43, but only serve to cover from view the grid 21 and light frame 42, including brackets 50 by means of a protruding lower lip 60.

To gain access to the fluorescent tube 48, light frame 42, and dome 41, it is merely necessary to reverse the steps stated above to remove the panel frame 45.

With the lights on, the panel frame 45 permits indirect reflected light and sound to pass through the panel frame central opening 53, while shielding the tubes 48 from direct view. When the material of the dome is sound absorbing, sound will be absorbed in the dome. The panel frame 45 serves to so shield the tubes 48, while simultaneously acting with the other panels 25 in the ceiling to provide a decorative and functional effect. With the light out, the panel frame 45 continues to provide decorative and functional ceiling effect.

The grid frame 43, the panel frame 45, the light frame 42 with its brackets 50, and the dome 41, combine to form the light fixture 40.

The brackets 50 on the light frame 42 support the light frame 42 on two opposing sides of the opening, leaving the intervening sides of the opening free to support panel frame 45.

The panel frame 45 can be inserted from below. The panel frame 45 can be formed of the same material as the adjacent ceiling panels.

The edge detail on intervening opposing sides C and D of panel frame 45 can also be that disclosed in co-pending application Ser. No. 09/141,407, incorporated herein by reference. Such edge detail also permits, by a series of shifts and rotations, the panel frame 45 to be positioned in the light fixture 40.

Since the installation and removal procedure of the panel frame 45 of the present invention requires virtually no activity above the beam flanges 31, the fixture 40, once installed, can be serviced with a minimum of difficulty.

In the event it is desired to remove the reflecting dome 40, as for instance for cleaning, the dome can be reached through an adjacent grid opening 23 by merely removing the adjacent panel 25, and retrieving and then reinserting the dome 41, which merely sits on the light frame 42.

The dome 41, the light frame 42, and the panel frame 45, described above, can be prefabricated and then combined with grid frame 43 during installation to form the fixture 40 of the invention.

The fixture in place provides a pleasing appearance, since the panel frame 45 is compatible with the rest of the ceiling, and through various designs, made to standout from or blend with the other panels.

The fluorescent tubes 48 are hidden from direct glare into the room below, with the light reflected in a soft manner that does not discourage viewing from below through central opening 53 of panel frame 45, to dome 41.

We claim:

1. In a suspended ceiling, a light fixture having, in combination:

(1) a rectangular grid frame with intersecting grid beams, a grid beam in cross section in the form of an inverted T having a vertical web and a horizontal flange at the bottom of the web, the flanges forming a horizontal shelf around the interior perimeter of the rectangular grid frame; the grid frame having first opposing sides (A) and (B), and intervening opposing sides (C) and (D);

(2) a fluorescent rectangular light frame extending within and around the interior of the grid frame and having brackets resting on the horizontal shelf around the interior perimeter of the grid frame on first opposing sides (A) and (B) of the interior perimeter of the grid frame, that keep the light frame within and above the grid frame on intervening opposing sides (C) and (D) of the grid frame; and having a fluorescent light tube extending along at least one side of the light frame;

(3) a reflecting dome extending above the light frame; and (4) a rectangular panel frame in supporting engagement with the interior perimeter of the grid frame on intervening opposing sides (C) and (D) of the grid frame, and free of supporting engagement with the grid frame on first opposing sides (A) and (B) of the grid frame; the panel frame having a perimeter portion that hides the light frame from view from below the ceiling, and an open central portion that permits light from the tube to be reflected by the dome into the space below the ceiling.

2. A fixture of claim 1 wherein the panel frame is in the form of a coffer.

3. In a suspended ceiling, a light fixture having, in combination:

(1) a rectangular grid frame with intersecting grid beams, a grid beam in cross section in the form of an inverted T having a vertical web and a horizontal flange at the bottom of the web, the flanges forming a horizontal shelf around the interior perimeter of the rectangular grid frame; the grid frame having first opposing sides (A) and (B), and intervening opposing sides (C) and (D);

(2) a fluorescent rectangular light frame extending within and around the interior of the grid frame and having brackets resting on the horizontal shelf around the interior perimeter of the grid frame on first opposing sides (A) and (B) of the interior perimeter of the grid frame, that keep the light frame within and above the grid frame on intervening opposing sides (C) and (D) of the grid frame; and having a fluorescent light tube extending along at least one side of the light frame;

(3) a reflecting dome extending above the light frame; and (4) a rectangular panel frame in supporting engagement with the interior perimeter of the grid frame on intervening opposing sides (C) and (D) of the grid frame, and free of supporting engagement with the grid frame on first opposing sides (A) and (B) of the grid frame; the panel frame having a perimeter portion that hides the light frame from view from below the ceiling, and an open central portion that permits light from the tube to be reflected by the dome into the space below the ceiling, wherein the panel frame is assembled into the fixture from below the suspended ceiling by first engaging the panel frame with one of the intervening opposing sides (C) and (D) of the grid frame, and then engaging the other of the intervening opposing sides (C) and (D) of the grid frame.

4. In a suspended ceiling, a light fixture having, in combination:

(1) a rectangular grid frame with intersecting grid beams, a grid beam in cross section in the form of an inverted T having a vertical web and a horizontal flange at the bottom of the web, the flanges forming a horizontal shelf around the interior perimeter of the rectangular grid frame; the grid frame having first opposing sides (A) and (B), and intervening opposing sides (C) and (D);

(2) a fluorescent rectangular light frame extending within and around the interior of the grid frame and having brackets resting on the horizontal shelf around the interior perimeter of the grid frame on first opposing sides (A) and (B) of the interior perimeter of the grid frame, that keep the light frame within and above the grid frame on intervening opposing sides (C) and (D) of the grid frame; and having a fluorescent light tube extending along at least one side of the light frame;

(3) a reflecting dome extending above the light frame; and (4) a rectangular panel frame in supporting engagement with the interior perimeter of the grid frame on intervening opposing sides (C) and (D) of the grid frame, and free of supporting engagement with the grid frame on first opposing sides (A) and (B) of the grid frame; the panel frame having a perimeter portion that hides the light frame from view from below the ceiling, and an open central portion that permits light from the tube to be reflected by the dome into the space below the ceiling, wherein the edge configurations on the panel frame that engage intervening opposing sides (C) and (D) on the grid frame, permit the panel frame to be inserted from below the suspended ceiling, with the dome and light frame in place above the grid frame.

5. A fixture of claim 4 wherein the panel frame has a thickness that permits the edge configurations.

6. The fixture of claim 1 wherein the brackets have an offset shoulder.

7. The fixture of claim 1 wherein at least one of the elements is formed of a composition having sound absorbing qualities.

8. In an indirect fluorescent light fixture supported in a ceiling grid in a suspended ceiling, having a light source and a dome for reflecting the light into a room;

the improvement comprising a rectangular panel frame that permits light to be reflected into a room while hiding the light source from view, wherein the panel frame has intervening opposing edges (C) and (D) that are in engagement with the grid, and first opposing edges (A) and (B) that are free of engagement with the grid, whereby the panel can be inserted into, and removed from the ceiling, from below, while the dome and fixture remain in place supported by the grid.

9. The fixture of claim 8 wherein the improvement also includes means on the light frame for creating a clearance above the grid for the panel frame.

10. The fixture of claim 9, wherein the means for creating a clearance above the grid for the panel frame comprises support brackets on the light frame on sides of the frame that correspond to first opposing sides (A) and (B) on the panel.

11. The fixture of claim 8 wherein the panel is in the form of a coffer.

12. The fixture of claim 8 wherein the panel is formed of a sound absorbing composition.

13. The fixture of claim 7 wherein said one element is the dome, and the open portion of the panel frame permits sound to reach the dome.

* * * * *